US009865936B2

(12) United States Patent
Neto et al.

(10) Patent No.: US 9,865,936 B2
(45) Date of Patent: Jan. 9, 2018

(54) ARRAY ANTENNA FEED STRUCTURES

(75) Inventors: Andrea Neto, Voorburg (NL); Daniele Cavallo, The Hague (NL); Giampiero Gerini, The Hague (NL); Reindert Grooters, Amsterdam (NL); Giovanni Toso, Delft (NL)

(73) Assignee: Nederlandse Organisatie Voor Toegepast-Natuurwetenschappelijk Onderzoek TNO, Delft (NL)

( * ) Notice: Subject to any disclaimer, the term of this patent is extended or adjusted under 35 U.S.C. 154(b) by 883 days.

(21) Appl. No.: 12/937,641

(22) PCT Filed: Apr. 14, 2009

(86) PCT No.: PCT/NL2009/050199

§ 371 (c)(1),
(2), (4) Date: Dec. 29, 2010

(87) PCT Pub. No.: WO2009/128716

PCT Pub. Date: Oct. 22, 2009

(65) Prior Publication Data

US 2011/0156976 A1 Jun. 30, 2011

(30) Foreign Application Priority Data

Apr. 14, 2008 (EP) ..... 08154491

(51) Int. Cl.
*H01Q 13/10* (2006.01)
*H01Q 21/06* (2006.01)
*H01Q 21/08* (2006.01)

(52) U.S. Cl.
CPC ..... *H01Q 21/064* (2013.01); *H01Q 13/10* (2013.01); *H01Q 21/08* (2013.01)

(58) Field of Classification Search
CPC ..... H01Q 21/064; H01Q 13/10; H01Q 21/08
(Continued)

(56) References Cited

U.S. PATENT DOCUMENTS

| | | | |
|---|---|---|---|
| 3,780,372 | A | 12/1973 | Unz |
| 6,359,596 | B1 | 3/2002 | Claiborne |
| 2005/0140556 | A1 | 6/2005 | Ohno et al. |

FOREIGN PATENT DOCUMENTS

| | | | |
|---|---|---|---|
| EP | 41 798 818 | 6/2007 | |
| EP | 1798818 A1 * | 6/2007 | ..... H01Q 1/38 |

(Continued)

OTHER PUBLICATIONS

J. J. Lee, Fellow, IEEE, Stan Livingston, Rick Koenig, Dennis Nagata, and Larry L. Lai, Compact Light Weight UHF Arrays Using Long Slot Apertures, IEEE Transactions on Antennas and Propagation, vol. 54, No. 7, Jul. 2006, pp. 2009-2015.*

(Continued)

*Primary Examiner* — Hoang Nguyen
*Assistant Examiner* — Jae Kim
(74) *Attorney, Agent, or Firm* — Fish & Richardson P.C.

(57) ABSTRACT

An array antenna has rectangular conductor sections, located successively side by side in a first plane, mutually separated by slots of constant width. A backing reflector is transverse to the first plane. Feed structures extend through the backing reflector, the feed structures comprising pairs of parallel feed conductors, each pair comprising conductors coupled to the rectangular conductor sections on opposite sides of a respective one of the slots.

22 Claims, 4 Drawing Sheets

(58) Field of Classification Search
USPC ..... 343/770
See application file for complete search history.

(56) References Cited

FOREIGN PATENT DOCUMENTS

| | | | | |
|---|---|---|---|---|
| FR | 2 661 782 | | 11/1991 | |
| GB | 2288913 A | * | 11/1995 | ..... H01Q 3/40 |

OTHER PUBLICATIONS

Kumar, B. Preetham, "Design of Unequally Spaced Arrays for Performance Improvement", *IEEE Transactions on Antennas and Propagation*, vol. 47:511-523, Mar. 1999 (13 pages).
Database Inspection, The Institution of Electrical Engineers Lee, J. et al., "Compact Light weight UHF arrays using long slot apertures", XP002493207, vol. 54, Jul. 2006. (1 page).
European Patent Office, "International Search Report", International Application No. PCT/NL2009/050199, dated Jul. 9, 2009 (5 pages).

* cited by examiner

Fig.3
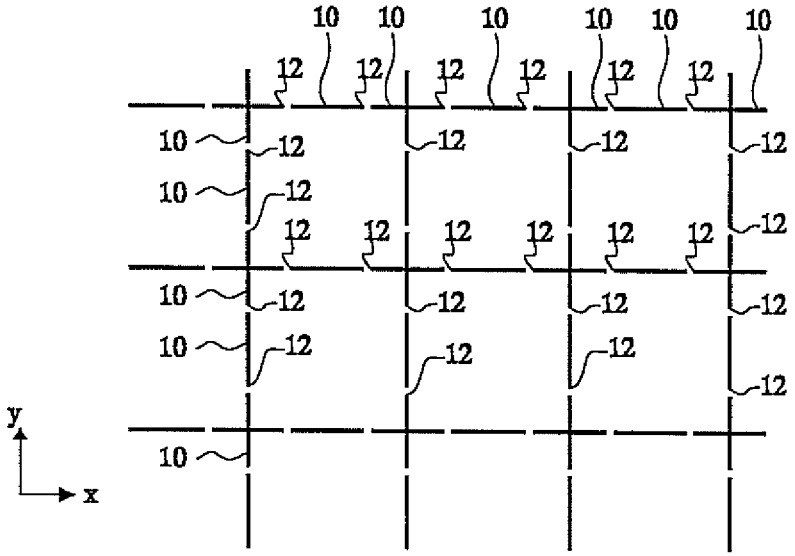
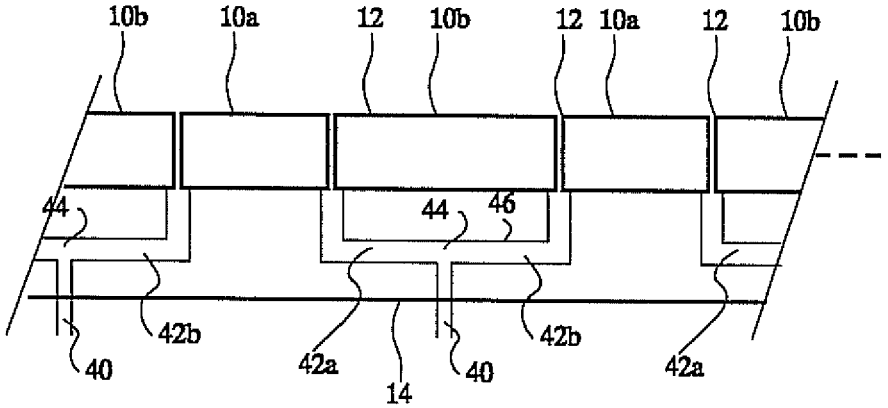
Fig.4

ARRAY ANTENNA FEED STRUCTURES

TECHNICAL FIELD

The invention relates to an array antenna and its operation.

BACKGROUND

U.S. Pat. No. 6,043,785 discloses an antenna according to the "Vivaldi" concept, comprising a dielectric strip with a metallization that forms an array of antenna elements. Each antenna element is formed by adjacent parts of the metallization with a tapered slot between these parts. The antenna element is fed with a field across the slot. An array of such antenna elements is formed by means of a series of such slots along the length of the dielectric strip.

It is known to form more complex arrays by placing a plurality of such strips in parallel to each other. An even more complex antenna may be formed with a grid of such strips, wherein a first plurality of mutually parallel strips is combined with a second plurality of mutually parallel strips, interlocking with the strips of the first plurality at right angles to the strips of the first plurality. Such an antenna is described in an article titled "A low profile wide-band (5:1) Dual-Pol Array" by J. J. Lee, S. Livingston and R Koenig in IEEE Antennas and Wireless Propagation Letters, 2, 2003.

This type of antenna provides for transmission and reception of radiation in a steerable beam direction with selectable polarization direction, and can be operated over a wide frequency bandwidth. The wide bandwidth is due to tapering of the slots. The selectable beam direction is controlled in transmission by the phase relation between the fields in the slots. The beam may be directed in a direction perpendicular to the rows and columns of the grid for example, by using fields of equal phase. When these fields are applied only to the slots of the strips of one of the pluralities of mutually parallel strips, a polarization direction parallel to these strips is obtained. A perpendicular polarization perpendicular to this can be obtained by applying the fields only to the slots of the other plurality of strips.

A disadvantage of this type of antenna is that it has been found to have relatively high cross-polarization, dependent on the direction in which the beam is steered. An array of such parallel strips causes an amount of polarization in a direction that does not correspond to the length of the strips. The polarizations generated by the rows and columns of the grid are not entirely orthogonal.

SUMMARY

Among others, it is an object to reduce cross-polarization from an array of parallel strips with antenna elements.

An antenna according to claim 1 is provided. Herein constant width slots are used between successive rectangular conductor sections. By avoiding slot tapering cross-polarization is reduced. In an embodiment, the rectangular conductor sections may be provided as metalized areas on a dielectric substrate. This also makes it possible to integrate feed conductors on the substrate.

In an embodiment, a backing reflector transverse to the plane of the rectangular conductor sections may be used behind the rectangular conductor sections, the feed structures extending through the backing reflector. In an embodiment the width of the slots is less than one percent of a wavelength in a transmission band of the antenna. This reduces cross-polarization.

In an embodiment, the edges of the rectangular conductor sections on mutually opposite sides of at least one of the slots are connected via a conductor loop that is electromagnetically coupled to a further feed conductor that leads to an input and/or output of the antenna, i.e. without conductive connection between the loop and the further feed conductor. In an embodiment, the pairs of edges adjoining each slot may be connected by a respective conductor loop in this way. The use of conductor loops suppresses common mode currents between the rectangular conductor sections, which has been found to lead to a significant reduction in cross-polarization.

In a further embodiment, the rectangular conductor sections, the parallel feed conductors, the conductor loop and the further feed conductor are formed by metalized areas on a dielectric substrate, such as a printed circuit board. Thus, a simple structure can be realized. In an embodiment, the further feed conductor may run through an area next to fields generated by the conductor loop. In an embodiment, the further feed conductor may form a partial or complete loop itself, at least partially overlapping with the conductor loop. In an embodiment, the electromagnetic coupling is realized using a further slot in a conductive strip in parallel with the plane of the rectangular conductor sections, the conductor loop partially overlapping the further slot and the further feed conductor running along at least part of the further slot. Thus, a tight coupling may be realized without undue cross-polarization. The further slot may have a width substantially equal to the width of the loop, which may be wider than the width of the slot between the rectangular conductor sections. This improves coupling. The further slot can be said to form a waveguide, with the conductor loop and the further feed conductor electromagnetically coupled to the waveguide.

In an embodiment, a T circuit feed structure is used, with branches to slots on to mutually opposite sides of the same rectangular conductor section. This makes it possible to realize a high density antenna. The feed structure may comprise conductor loops connected between opposing edges of rectangular conductor sections with branch conductors of the T junction extending towards the loops providing for electromagnetic coupling to the loops. In this way, cross-polarization due to common mode currents can be reduced. In an embodiment, the electromagnetic coupling is realized using further slots in a conductive strip in parallel with the plane of the rectangular conductor sections. The loops partially overlap respective ones of these slots and the branches run along at least part of respective ones of these further slots. Thus, a tight coupling may be realized without undue cross-polarization. In an embodiment the conductive strip forms one of the feed conductors of the common part of the T junction.

In an embodiment, the antenna contains a plurality of such arrays in parallel with each other. This enables redirection of the antenna beam in two directions with low cross-polarization. In a further embodiment, two such pluralities of arrays are provided at right angles to each other. This enables the use of two polarization directions.

The antenna may use used in a phased array system wherein the phase of the signals of different slots is adapted relative to each other to steer the beam.

BRIEF DESCRIPTION OF THE DRAWINGS

These and other objects and advantageous aspects will be become apparent from a description of exemplary embodiments, using the following figures.

FIG. 3 shows a grid of such strips.
FIG. 4 shows an array of antenna elements.

DETAILED DESCRIPTION OF EXEMPLARY EMBODIMENTS

Figure 1:
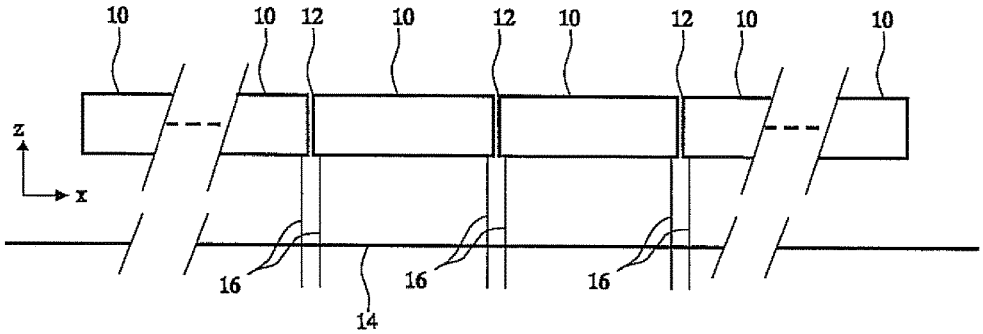
FIG. 1 shows an array of antenna elements.

FIG. 1 shows an antenna with an array of rectangular conductor sections 10, separated by slots 12, viewed laterally. Conductor sections 10 may be successive metalized areas along on an isolating dielectric substrate. In this case, the sections have the same width as the strip. The direction of succession of conductor sections 10 will be termed the x-direction. Conductor sections 10 are located above a backing reflector 14 (seen in cross-section). Backing reflector 14 may be provide in the form of a plane shaped conductor, extending over at least the length of the conductor sections and over some distance on mutually opposite sides of the plane of the conductor sections 10 (if an array of arrays of the type of FIG. 1 is provided in parallel planes, the ground plane conductor may extend to cross all these planes, and/or in the case of a single array it may extend at least half a wavelength on either side of the plane). Preferably, backing reflector 14 extends perpendicular to the plane of the array in order to produce symmetric beams, but another angle different from zero may be used. The direction from backing reflector 14 to conductor sections 10 will be termed the z-direction. Pairs of feed conductors 16 are provided, running through backing reflector 14 in the z-direction and each coupled to the conductor sections 10 on mutually opposite sides of a respective one of the slots 12. The slot width and the distance between feed conductors 16 are shown exaggerated for the sake of illustration.

An isolating dielectric substrate may be provided attached to backing reflector 14, with metallization forming conductor sections 10 and feed conductors 16. Thus, feed line may be implemented as coplanar strip transmission lines. In an embodiment, the substrate extends to the top edge of conductor sections 10.

Figure 1A:
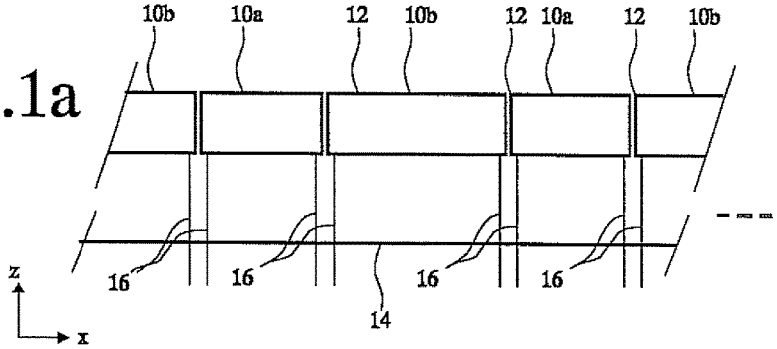

FIG. 1*a* shows an antenna wherein the distance between slots 12 varies. As illustrated, the distance alternately takes a first and second value. As a result, the array successively contains alternating conductor sections 10*a*, 10*b* of mutually different length. In FIG. 1 a constant distance may be used.

In each slot 12, the edges of conductor sections 10 adjoining the slot run parallel to each other over the full width of the conductor sections 10. Each slot 12 has substantially constant slot-width over the width of the conductor sections 10. The edges of the conductor sections 10 between successive slots 12 are aligned along lines that run in the x-direction, parallel to backing reflector 14.

In operation, electric fields are applied through and/or received from feed conductors 16. It may be noted that the geometry of the array ensures reception or transmission of one polarization component and rejects reception or transmission of the other polarization component. The polarization is mainly determined by currents along the top and/or bottom edge of the conductor sections 10, i.e. the direction between successive slots 12 (the x-direction). A high degree of isolation between the polarizations is realized because the currents in the z-direction run only along the edges of conductor sections 10, in parallel with mutually opposite sides of the slots 12, at close distance to each other. These currents have mutually opposite signs, which has the effect that the fields due to these currents cancel in transmission, respectively that received radiation with polarization parallel to the slot 12 generates substantially no differential currents along the edges of the slot 12.

In an embodiment of an antenna for 14.5 GHz signals (wavelength 20.7 millimeters), the width of slots 12 was chosen to be 0.1 mm. To increase bandwidth the slot is preferably as narrow as possible. In general, in the case of small slot width, the slot width co-determines the impedance seen between successive conductor sections 10. In this case, the slot width may be chosen to match supply impedance. An impedance of 400 Ohms may be used. As may be noted, the slot width is much less than a wavelength (less than 10% of a wavelength), which substantially suppresses net radiation due to mutually opposite currents on opposite sides of the slot 12. A constant slot width of less than five percent of the wavelength is preferable used. In an embodiment, the distance from backing reflector 14 to the middle of conductor sections 10 was taken 0.31 times the wavelength, and preferably less than half a wavelength at the highest used frequency.

The size of conductor sections 10 may be chosen in proportion to the wavelength of the transmitted or received radiation. In an embodiment, the width of the sections (in the z-direction) was taken as 0.05 times the wavelength. The lengths of conductor sections 10*a,b* where taken as 0.29 and 0.16 times the wavelength respectively. This enabled a 44% bandwidth relative to the central frequency. In the case of FIG. 1, the length of conductor section 10 may be taken as 0.36 times the wavelength. In general, the bandwidth may be increased by making the width and the length of the conductor sections as small as possible. But this is limited by practical considerations, such as avoiding the need for an excessive number of feeds to respective sections and manufacturability. This makes it desirable to use greater length and at least a minimum width. However, width and length less than resonant lengths are preferably used. Thus, the length of sections 10 is preferably kept less than half a wavelength at the highest frequency in the operational frequency band. As may be noted, when the width of sections 10 is very small, the section 10 may be line-like and only nominally rectangular. The word rectangular is used here to indicate that the sections 10 have no significant skewed edges at an angle other than ninety degrees to the length of sections 10.

For transmission purposes, a driver circuit (not shown) may be provided for supplying signals to feed conductors 16, with controllable phase shifter for adjusting a phase relation between the signals at different feed conductors 16. Similarly, for reception purpose, a receiver circuit (not shown) may be provided that combines signals derived from the respective pairs of feed conductors 16, after applying controllable relative phase shifts.

Figure 2:
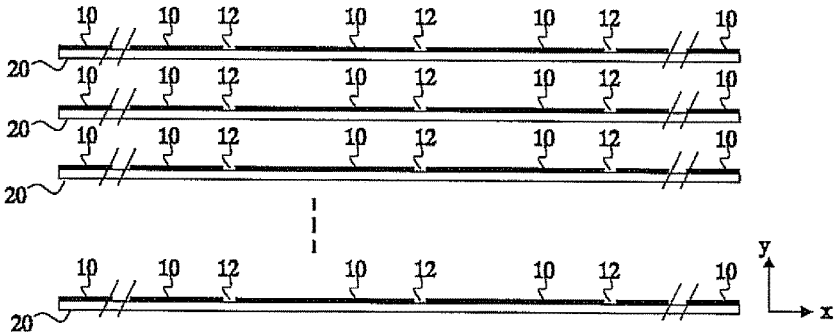
FIG. 2 shows an a broadside view.

FIG. 2 shows a broadside view of a plurality of such arrays of antenna elements in parallel. In terms of FIG. 1, conductor sections 10 are shown from an elevation in the z-direction, in an x-y plane (y being a direction perpendicular to the x and z-direction). As can be seen, conductor sections 10 are flat, thin structures, with a much smaller thickness in the y-direction than the length and width in the x and a direction respectively. In the illustrated embodiment, the conductor sections 10 take the form of metallization on strips 20 of dielectric material. However, conductor sections 10 may be supported in other ways, for example on the feed conductors (not shown). In an embodiment, the arrays may be placed at regular distances, so that distances between successive arrays is each time the same. Alternatively, irregular distances may be used.

FIG. 3 shows a broadside view of a grid with rows and columns of arrays of antenna elements as shown in FIG. 1. The rows and columns intersect each other at right angles. At the intersections, the conductor sections of the rows and columns are electrically connected, so that the conductor sections may be considered to continue through the intersections. In the illustrated embodiment, there are each time two slots 12 between successive intersections. In an embodiment, the rows may be placed at regular distances, and the columns may be placed at regular distances, using the same mutual distances for rows and columns.

The distances between slots 12 along an array of conductor sections may vary, taking alternatingly two values for example. The distance between slots that are located both between adjacent crossing arrays may be taken larger than the distance between slots on mutually opposite sides of a crossing array.

In transmission operation, feed conductors 16 apply electric fields across slots 12. The fields may be derived from a single input signal, by passing the input signal to the feed conductors 16 through controllable phase shifters. The phase shifts are set according to a required antenna pattern, in particular according to a require beam direction. In the case of a single array of conductor sections 10, angle between the beam direction and the length of the array may be controlled. In the case of a plurality of rows of arrays, two angles of the beam direction may be controlled, relative to the length of the arrays and relative to the direction in which the rows succeed each other. Similarly, in reception operation, signals derived from feed conductors 16 may be combined after applying relative phase shifts dependent on a required beam direction.

Different components of polarization may be received or transmitted with the grid of FIG. 3. The rows are used for a first polarization component and the columns are used for a second polarization component. Thus, in transmission, the signals applied to the feed conductors 16 of the rows are controlled dependent on a required first polarization component and the feed conductors 16 of the columns are controlled dependent on a required second polarization component. In reception, a first polarization component signal is obtained by combining signals from feed conductors of the rows and a second polarization component signal is obtained by combining signals from feed conductors of the columns.

In the case of the array of FIG. 2, only one polarization component can be controlled or received, the arrays functioning to reject the other polarization component. A pair of antennas like with rows of parallel array that of FIG. 2 may be used, the rows in one antenna of the pair being oriented at an angle of for example ninety degrees relative to the rows of the other antenna of the pair.

As noted, the geometry of the arrays ensures reception or transmission of one polarization component and rejects reception or transmission of the other polarization to component in the array. This ensures reduction of cross-polarization effects in transmission and reception. The feed conductors run perpendicular to the backing reflector 14, that is, in a current direction that could give rise to undesirable polarization components, but because pairs of the feed conductors run close together, from mutually opposite ends of adjacent sections 10, at a mutual distance that need be no more than the distance between such opposite ends, they lead to negligible radiation.

FIG. 4 shows an antenna with an array of rectangular conductor sections 10*a,b*, wherein a shared feed structure is used for a pair of slots 12. The feed structure has a common part 40, branch parts 42*a,b* and a T-junction 44 between common part 40 and branch parts 42*a,b*. Common part 40 comprises a pair of feed conductors in parallel to each other. Similarly, branch parts 42*a,b* each comprise a pair of feed conductors in parallel to each other. The pair of feed conductors of common part 40 passes through backing reflector 14. The pairs of feed conductors of branch parts 42 run to slots 12 on mutually opposite sides of a conductor section 10*b* of the array. The feed structure makes it possible to realize a very dense array with a reduced number of feeds.

At T-junction 44, a first feed conductor 46 of branch parts 42*a,b* runs from one branch part 42*a* on to the other branch part 42*b*. Second feed conductors of branch parts 42*a,b* continue into respective feed conductors of common part 40. In the illustrated embodiment, the first feed conductors of branch parts 42*a,b* connect to mutually opposite sides of the same conductor section 10*b* of the array, so that the first feed conductors and the conductor section 10*b* form a loop. Alternatively, the second feed conductors of branch parts 42*a,b* may run on to the respective feed conductors of common part 40, so that the feed conductors of common part 40 are coupled to mutually opposite sides of a same conductor section 10*b* of the array.

In an embodiment, the distance between the feed conductors in branch parts 42*a,b* is taken to make the transmission line impedance Zb of the transmission line formed by these feed conductors substantially equal to the impedance Za seen between conductor sections 10*a,b* across the slots 12, times the square root of two (assuming that the impedance Za equals the transmission line impedance Zc of common part 40, otherwise Zb may be taken sqrt(2*Za*Zc)). Furthermore, the length of branch parts is taken equal to a quarter wavelength. Thus, impedance matching is realized.

It has been found that with a non-resonant array of conductor sections 10*a,b* with a single slot the impedance seen across the slot would have a real part that corresponds to free space impedance (about 370 Ohms). By using a larger number of slots 12, at distances less than or equal to half a wavelength, this impedance can be reduced, making it easier to provide for matching. The impedance of slots 12 has a capacitive imaginary part. The feed structure with a T junction can be used to reduce the effect of the imaginary part and to realize a real part the antenna terminals that simplifies matching. Moreover, this type of the feed structure fits well into the antenna structure, making it possible to realize a large number of slots 12.

In this way, an antenna is provided wherein at least one of the feed structures comprises a respective first and second one of the pairs of feed conductors, coupled to slots on mutually opposite of a respective one of the rectangular conductor sections; a common part with parallel feed conductors extending through the backing reflector; and a T-junction, coupling the common part to the first and second one of the pairs of feed conductors between the backing reflector and the array.

In an embodiment, this antenna may be realized so that the first and second one of the pairs of feed conductors each comprise a first conductor and second conductor, the first conductors being connected to each other at the T junction, the second conductors being connected to the conductors of the common part respectively, the first conductors being coupled to a same conductor section or to conductor sections abutting to the slots on mutually opposite sides of a same conductor section. In a further embodiment, an isolating dielectric substrate may be used, the rectangular conductor sections and the feed conductors being formed by metalized areas on the substrate.

Figure 5:
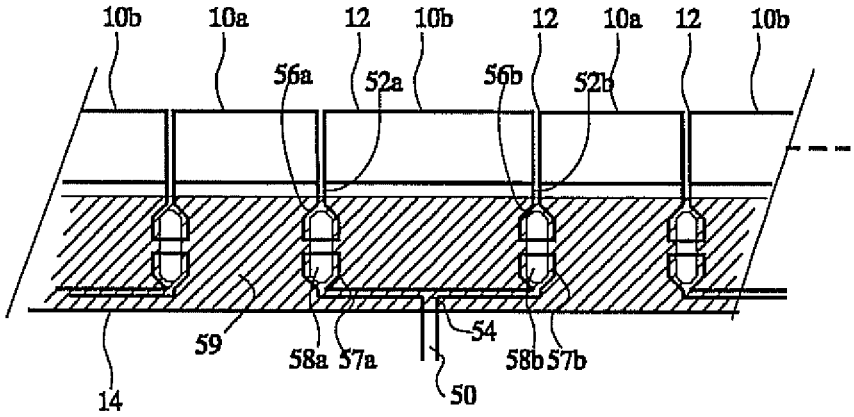
FIGS. 5-10 illustrate feed structures.

FIG. 5 shows an antenna with an array of rectangular conductor sections 10*a,b*, wherein a feed with an intermediate coupling element is used for a pair of slots 12. The figure shows the feed seen perpendicularly to the plane of rectangular conductor sections 10*a,b*. The feed structure comprises a common part 50 with a pair of feed conductors in parallel to each other. A first pair of feed conductors 52*a* and a second pair of feed conductors 52*b* run to slots 12 on mutually opposite sides of a conductor section 10*b* of the array. A first conductor loop 56*a* has ends coupled to the feed conductors of the first pair 52*a*. A second conductor loop 56*b* has ends coupled to the feed conductors of the first pair 52*b*.

A T-junction 54 splits common part 50 into two branches, which run to a third and fourth conductor loops 57*a,b*. A first and second waveguide 58*a,b* are provided as a coupling element to couple third conductor loop 57*a* and first conductor loop 56*a* and to couple fourth conductor loop 57*b* and second conductor loop 56*b* respectively. In the illustrated embodiment, the waveguides 58*a,b* are realized as slots in a conductive strip 59 (shown by shading) that lies next to the row of rectangular conductor sections 10*a,b*. Waveguides 58*a,b* may be dimensioned to form resonators for electromagnetic waves along the loop conductor at a central frequency of an operating band. This improves coupling. The loading of the resonator via the conductive loops prevents sharp resonant behaviour and strong radiation from the waveguides 58*a,b*.

This structure has the advantage that it minimizes coupling of a common mode component from rectangular conductor sections 10*a,b* to the antenna terminals. For a common mode component (average potential of adjacent rectangular conductor sections 10*a,b*), the first and second conductor loops 56*a,b* are open ends, so that little or no common mode current will flow at the interface part of the conductor loops 56*a,b*, i.e. the part closest to the third and fourth conductor loops 57*a,b*. This suppresses coupling of the common mode. It has been found that a common mode component can lead to cross-polarization. This is avoided by the use of a feed with conductor loops 56*a,b* coupled to the opposing edges of rectangular conductor sections 10*a,b*. As will be appreciated, the use of conductor loops 56*a,b* connected to the edges adjoining a slot 12 provides for the suppression of the common mode component. Preferably, the size of the loops 56*a,b* and the conductors to the loops is kept so small that a low impedance for the common mode is realized at over the operating frequency band. The waveguides 58*a,b* and further conductor loops 57*a,b* provide for an advantageous solution for tight coupling to the loops, but other structures may be used to provide for coupling with little common mode. Overlapping or touching loops may be used for example, without waveguides 58*a,b*.

In an embodiment, the rectangular conductor sections 10*a,b* and the feed structure may be realized on a non-conductive substrate, with two conductor layers on it, isolated from each other, rectangular conductor sections 10*a,b*, pairs of feed conductors 52*a, b*, common part 50 and conductor loops 56*a,b*, 57*a,b* may be realized by patterning one of these layers and conductive strip 59 and waveguide slots 58*a,b* may be realized by patterning the other layer. Alternatively, more conductor layers may be used. Preferably, distance between rectangular conductor sections 100 and conductive strip 59 is minimized, without allowing them to overlap.

In another embodiment, a sandwich of non-conductive layers and, with at least three mutually isolated layers is used, with the first and second conductor loops 56*a,b*, in a first conductive layer, conductive strip 59 in a second conductive layer and common part 50 and third and fourth conductor loops 57*a,b* in a third conductive layer. In this embodiment, adjacent loop parts of first conductive loop 56*a* and third conductive loop 57*a* can be overlapping, seen perpendicularly to the surface of the conductive layers. The same goes for second conductive loop 56*b* and fourth conductive loop 57*h*. This increases coupling. It has been found that good coupling improves operation. Also when the adjacent parts of the loops do not overlap, it is preferred that they are close together.

Figure 6:
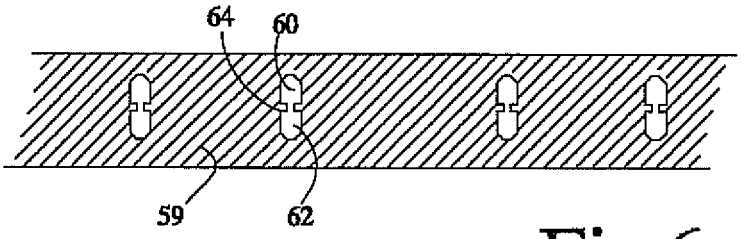

FIG. 6 shows an embodiment wherein the waveguide slots 58*a,b* may have a first and second area 60, 62 of a first width and a neck 64 between the first and second area 60, 62 with a second width that is smaller than the first width. This makes it possible to select the coupled parameters by selecting the width and length of the neck 64. First or second conductor loop 56*a,b*, preferably runs along the circumference of first area 60. Third or fourth conductor loop 57*a,b*, preferably runs along the circumference of second area 62. Neck 64 enables fine tuning of impedance values.

Figure 7:
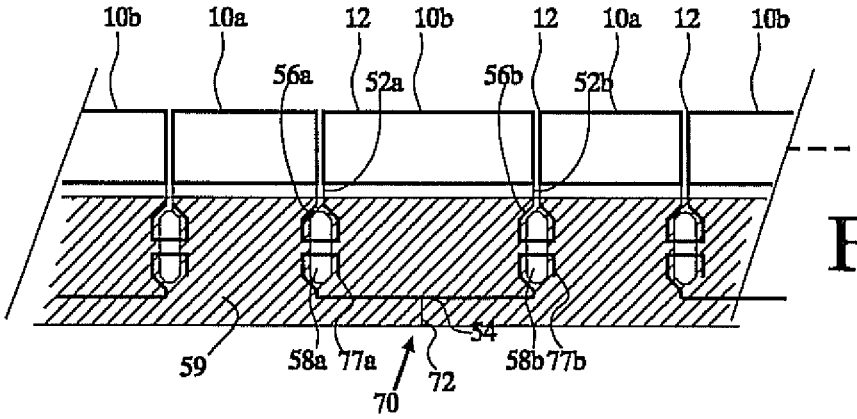

FIG. 7 shows an embodiment similar to that of FIG. 5, wherein common part 70 of the feed structure comprises a ground plane that is formed by conductive strip 59, with one conductor line 72 facing this ground plane. In this embodiment, only the one conductor line 72 splits at the T junction 74. In this embodiment, single branch conductors are used from T junction 74 facing the ground plane. Partial third and fourth loops 77*a,b* are used, which are considered parts of the branch conductors that run along the edge of the waveguides 58*a,b* formed by the slots. Preferably, the partial loops 77*a,b* run along the edge of the slots to an interface section where they lie closest to the first and second loop, running on away from the interface part for a quarter wavelength of propagation of electromagnetic waves along the loop conductor at a central frequency of an operating band. Thus a current maximum is realized in the interface part, which provides for optimal coupling.

Figure 8:
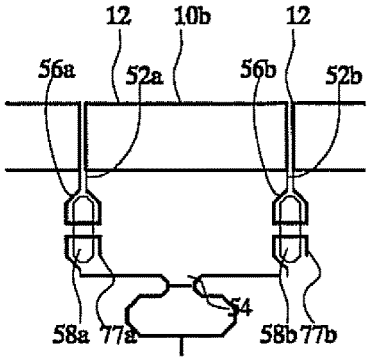

FIG. 8 shows a further embodiment, wherein a more complex T junction is used, wherein the two branches diverge from a first point of divergence and converge back towards each other at a point where the branches are coupled via a resistor 80, before diverging again towards the third and fourth conductor loops. The length of each branch between the first point of divergence and the resistor preferably corresponds to a quarter wavelength of propagation of electromagnetic waves along the branches at a central frequency of an operating band. The use of a conductor strip 59 makes it easy to include such a structure.

Conductive strip 59 may be located between the backing reflector and the rectangular conductor sections 10*a,b*. In this case, conductive strip 59 may be electrically connected to the backing reflector. In alternative embodiments, the backing reflector may be omitted. Although the embodiments with conductor loops have been shown for an embodiment with rectangular conductor sections of unequal widths, it should be appreciated that they may be used also for embodiments with rectangular conductor sections with equal widths.

Figure 9:
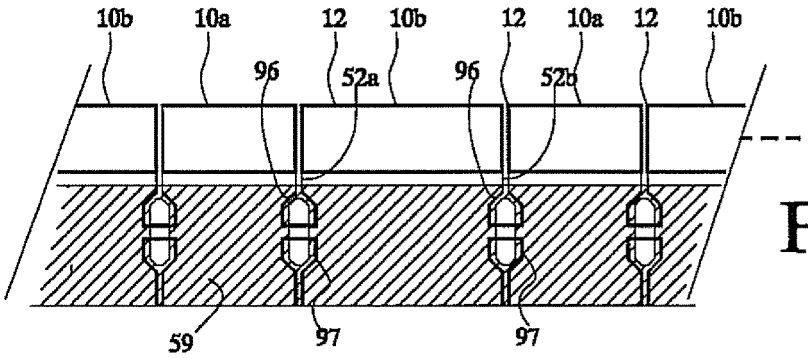
Figure 10:
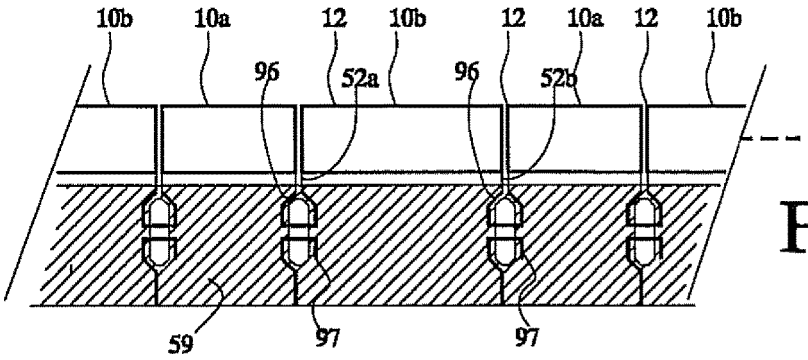

Feed structures similar to those shown in the preceding figures may be used for a plurality of rectangular conductor sections 10*a,b*. FIG. 9 shows an embodiment without T junctions. Herein, conductor loops 96, 97 similar to those of the preceding figures are used coupled by a waveguide in a conductive strip 59. A first one of these conductor loops 96 is coupled to opposing ends of rectangular conductor sections 10*a,b*. A second one of these conductor loops 96 is coupled to an antenna terminal. FIG. 10 shows a similar embodiment, wherein one of the conductors of the antenna terminal is formed by the conductive strip 59. In this embodiment, a partial conductor loop 97 is used on the side of the antenna terminal. By using conductor loops 96 connected to the edges of slots 12 common mode current can be suppressed, which has been found to provide a significant improvement of the suppression of cross-polarization.

The invention claimed is:

1. An antenna comprising:

an array of rectangular conductor sections, located successively side by side extending in a first plane, mutually separated by slots of constant width; and feed structures, each feed structure comprising a pair of parallel feed conductors, a first one of the pair of parallel feed conductors and a second one of the pair of parallel feed conductors ending in galvanic contact with the rectangular conductor sections at the corners of the rectangular conductor sections on opposite sides of a respective one of the slots, wherein at least one of the feed structures comprises:

a conductor loop associated with the pair of parallel feed conductors, the conductor loop comprising a conductor that runs from the first one of the parallel feed conductors in the pair to the second one of the parallel feed conductors in the pair along a perimeter of a loop area that is not intersected by other conductors; and a further feed conductor coupled to an input and/or output of the antenna, and electromagnetically coupled to the conductor loop.

2. The antenna according to claim 1, comprising an isolating dielectric substrate, the rectangular conductor sections, the parallel feed conductors, the conductor loop and the further feed conductor being formed by metalized areas on the substrate.

3. The antenna according to claim 1, comprising:

a conductive strip extending in parallel with said first plane, isolated from the rectangular conductor sections, and a further slot in the conductive strip, the conductor loop partially overlapping with said further slot, the further feed conductor running at least partly along and edge of the further slot.

4. The antenna according to claim 3, wherein the further slot comprises a first and second area, both having a first width, and a neck between the first and second area, the slot at the neck having a second width that is smaller than the first width, the conductor loop overlapping at least partially with said first area, the further feed conductor running along an edge of the second area.

5. The antenna according to claim 3, wherein the further feed conductor forms a further conductor loop, the further conductor loop partially overlapping the further slot.

6. The antenna according to claim 1, wherein at least one of the feed structures comprises:

a respective first and second one of the pairs of feed conductors, coupled to slots on mutually opposite sides of a respective one of the rectangular conductor sections;

a common part with feed conductors extending in parallel; and a T-junction, coupling the common part to the first and second one of the pairs of feed conductors.

7. The antenna according to claim 6, wherein said at least one of the feed structures comprises a first and second conductor loop extending at least in parallel with said first plane, the first and second conductor loop connected between the feed conductors of the first and second one of the pairs of feed conductors respectively, the T junction having a first and second conductor branch coupled to the common part, the first and second conductor branch electromagnetically coupled to the first and second conductor loop respectively.

8. The antenna according to claim 1, wherein a length of the rectangular conductor sections between successive slots is greater than a width of the rectangular conductor sections along a length of the slots.

9. The antenna according to claim 1, wherein the array of rectangular conductor sections alternatingly includes first rectangular conductor sections having a first length between successive slots and second rectangular conductor sections having a second length between successive slots, the first length being larger than the second length.

10. The antenna according to claim 1, wherein the width of the slots is less than ten percent of a wavelength in a transmission band of the antenna.

11. The electronic system comprising an antenna according to claim 1, a first common input and/or output and a phase control circuit with controllable phase shifters, a plurality of the pairs of feed conductors being coupled to the first common input and/or output via respective ones of the phase shifters.

12. The electronic system according to claim 11, comprising a second common input and/or output, the first and second common input/output for respective polarization directions respectively, wherein the antenna is a first antenna and the electronic system further comprises a second antenna, wherein each antenna comprises first and second sets of arrays with pairs of feed conductors, the pairs of feed conductors of the first set of arrays being coupled to the first common input and/or output via respective first phase shifters, the pairs of feed conductors of the first set of arrays being coupled to the second common input and/or output via respective second phase shifters, the planes of the arrays in the first set being parallel to each other, the planes of the arrays in the second set being parallel to each other, the planes of the arrays in the first set intersecting the planes of the arrays in the second set at right angles.

13. The antenna according to claim 1, wherein first edges of the rectangular conductor sections that extend along the slots are shorter than second edges of the rectangular conductor sections that extend between different ones of the slots.

14. The antenna according to claim 1, wherein the conductors and the loop areas of said conductor loops lie in said first plane.

15. The antenna according to claim 1, comprising a plurality of arrays of rectangular conductor sections, each array having an associated first plane, the associated first planes of different ones of the arrays being parallel to each other and offset at a distance from each other, each array comprising rectangular conductor sections located successively side by side extending in the first plane associated with the array, mutually separated by slots of constant width, and feed structures with pairs of feed conductors, each pair comprising conductors ending in electrical contact with the rectangular conductor sections on opposite sides of a respective one of the slots.

16. An antenna comprising:

an array of rectangular conductor sections, located successively side by side, with rectangular surfaces of each of the rectangular conductor sections in the array extending in a first plane, mutually separated by slots of constant width;

feed structures, each feed structure comprising a pair of parallel feed conductors, each pair comprising conductors ending in galvanic contact with the rectangular conductor sections at corners of the rectangular conductor sections on opposite sides of a respective one of the slots; and a backing reflector extending in a second plane, the second plane crossing said first plane, the feed structures extending through the backing reflector.

17. The antenna according to claim 16, wherein at least one of the feed structures comprises:

a respective first and second one of the pairs of feed conductors, coupled to slots on mutually opposite sides of a respective one of the rectangular conductor sections;

a common part with parallel feed conductors extending through the backing reflector; and a T-junction, coupling the common part to the first and second one of the pairs of feed conductors between the backing reflector and the array.

18. The antenna according to claim 17, wherein the first and second one of the pairs of feed conductors each comprises a first conductor and second conductor, the first conductors being connected to each other at the T junction, the second conductors being connected to the conductors of the common part respectively, the first conductors being coupled to a same conductor section or to conductor sections abutting to the slots on mutually opposite sides of a same conductor section.

19. The antenna according to claim 16, comprising a plurality of arrays of rectangular conductor sections, each on a same side of the backing reflector, each array having an associated first plane, the first planes being parallel to each other, each array comprising rectangular conductor sections located successively side by side extending in the first plane associated with the array, mutually separated by slots of constant width, and feed structures with pairs of feed conductors, each pair comprising conductors coupled to the rectangular conductor sections on opposite sides of a respective one of the slots.

20. The antenna according to claim 19, comprising a further plurality of arrays of rectangular conductor sections, each on said same side of the backing reflector, each further array having an associated third plane, the third planes at right angles to said first planes, each further array comprising rectangular conductor sections located successively side by side in the third plane of the further array, mutually separated by slots of constant width, and pairs of feed conductors, each pair comprising conductors coupled to the rectangular conductor sections on opposite sides of a respective one of the slots.

21. The antenna according to claim 16, wherein the second plane crosses the first plane at right angles.

22. The antenna according to claim 16, wherein first edges of the rectangular conductor sections that extend along the slots are shorter than second edges of the rectangular conductor sections that extend between different ones of the slots.

* * * * *